US006994466B2

(12) United States Patent
Kojima

(10) Patent No.: US 6,994,466 B2
(45) Date of Patent: Feb. 7, 2006

(54) TIMEPIECE WITH TIME CORRECTION MECHANISM

(75) Inventor: Hiroyuki Kojima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 352 days.

(21) Appl. No.: 10/369,380

(22) Filed: Feb. 19, 2003

(65) Prior Publication Data

US 2003/0161219 A1 Aug. 28, 2003

(30) Foreign Application Priority Data

Feb. 19, 2002 (JP) ..... 2002-042048
Dec. 9, 2002 (JP) ..... 2002-356811

(51) Int. Cl.
*G04B 27/04* (2006.01)

(52) U.S. Cl. ..... 368/191; 368/220

(58) Field of Classification Search ..... 368/184, 368/185, 190–192, 196, 197, 220, 308, 319–321
See application file for complete search history.

(56) References Cited

U.S. PATENT DOCUMENTS 3,148,499 A * 9/1964 Dominick ..... 368/60
4,788,669 A * 11/1988 Kamiyama ..... 368/80
4,811,312 A * 3/1989 Cole ..... 368/107
4,845,693 A * 7/1989 Kubota ..... 368/185
4,932,011 A * 6/1990 Schwartz ..... 368/185
5,214,625 A * 5/1993 Suzuki et al. ..... 368/192
6,773,157 B1 * 8/2004 Grau ..... 368/308
6,779,916 B2 * 8/2004 Watanabe ..... 368/190

FOREIGN PATENT DOCUMENTS

JP 8-27360 3/1996
JP 2617200 3/1997
JP 11-174165 7/1999

* cited by examiner

*Primary Examiner*—P. Austin Bradley
*Assistant Examiner*—Jeanne-Marguerite Goodwin
(74) *Attorney, Agent, or Firm*—Mark P. Watson

(57) ABSTRACT

In order to position a clutch plate 20 in a first angular position, in which teeth 2*a* of a second gear 2 mesh with a pinion 3*b* of a third gear 3, an abutment 21 and a projection 12 are provided on the clutch plate 20 and a main plate 10, respectively. An abutment surface 21A that is substantially perpendicular to a straight line α connecting between centers of rotation of the gears 2, 3 is provided on abutment 21. The abutment surface 21A restricts displacement in a direction, in which a distance between the centers of rotation of the gears 2, 3 is decreased, to prevent deformation of the clutch plate 20, which leads to deep meshing of the gears 2, 3, and rotating drive resistance of the gears 2, 3 is maintained small to prevent an increase in loss of mechanical energy and prevents unwanted stoppage of the timepiece 1.

8 Claims, 10 Drawing Sheets

TIMEPIECE WITH TIME CORRECTION MECHANISM

BACKGROUND OF THE INVENTION

1. Field of the Invention

The present invention relates to a timepiece, such as a watch, wristwatch, clock, or the like, in which time is indicated by indication members such as hands or the like, mounted on gears, which form a gear train, and which comprises a time correction mechanism operated by an external operation member transmitting an external operating force to the inside of the timepiece.

2. Description of the Related Art

Conventionally, there have been used timepieces, in which hands rotating at predetermined rotating speeds point to numerals or graduations marked on a dial.

Generally, such timepieces are provided with a time correction mechanism, which permits manual operation to rotate hands for the purpose of correction of the indicated time.

As disclosed in JP-B-8-27360, a time correction mechanism has been known, in which a clutch plate is movably provided to engage with a shaft of a third gear provided with a pinion adapted to mesh with a second gear.

With such time correction mechanism, when a winding stem is pulled out to move the clutch plate, a posture of the third gear is inclined to separate the pinion of the third gear from the second gear, so that meshing of the second gear and the third gear is released. Thereby, a force of rotating operation applied on the winding stem for correction of time is not transmitted to a mechanism of speed regulation provided on the third gear or a succeeding gear, whereby it is possible to freely carry out an operation of time correction.

The time correction mechanism comprises a slot formed in the clutch plate, a positioning pin inserted through the slot, and an engagement projection engageable with the positioning pin and arranged on a central portion in a longitudinal direction of the slot.

When the clutch plate is to be moved, the engagement projection provided on the slot engages with the positioning pin, so that the clutch plate is not moved unless a somewhat large operating force is applied.

Thereby, the clutch plate is not moved inadvertently, so that it can be held in two predetermined positions except for intended operation and advancing and retreating motions of a winding stem can be made moderate.

With such time correction mechanism, since forces, with which the winding stem is pulled out or in, cause movement of the clutch plate and a somewhat large operating force is necessary for operation of the winding stem, there is caused a problem that large forces are in some cases applied on the winding stem and the clutch plate, and so strength for the winding stem and the clutch plate must be adequately ensured, by which it is necessary to adequately increase a diameter of the winding stem and a thickness dimension of the clutch plate, thereby causing a problem that thin sizing and miniaturization of the timepiece are impeded.

Besides, there is also caused a problem that when it is tried to surely hold the clutch plate in either of the two predetermined positions, a large force is made necessary in operation of the winding stem, and a smooth operation of the winding stem becomes difficult, so that an uncomfortable feeling results in operation.

FIG. 7 shows a clutch plate 80 for solving the above-mentioned problem. That is, the clutch plate 80 pivotally supports a shaft 3*c* (FIG. 8) on a side of a pinion 3*b* of a third gear 3 as shown in FIGS. 7 and 8. In addition, a shaft 3*d* on a side of a gear 3*a* of the third gear 3 is pivotally supported on a gear train bridge 9. Also, the reference numeral 8 in FIG. 8 denotes an hour gear.

The clutch plate 80 is supported by a rotating shaft 11, which is provided upright on a main plate 10, so as to be able to turn between a first angular position A, in which a gear 2*a* of a second gear 2 and the pinion 3*b* of the third gear 3 mesh with each other, and a second angular position B, in which meshing of the gear 2*a* of the second gear 2 and the pinion 3*b* of the third gear 3 is released but meshing of the gear 3*a* and a pinion 4*b* of a fourth gear 4 is not released.

Provided on the main plate 10 are a projection 12 for restricting a position of an abutment 81 of the clutch plate 80 so as to prevent the clutch plate from turning further in a clockwise direction in the figure from the first angular position A, and a projection 13 for restricting a position of a tip end 20A of the clutch plate 80 so as to prevent the clutch plate from turning further in a counterclockwise direction in the figure from the second angular position B.

Here, the abutment 81 of the clutch plate 80 is provided with an abutment surface 81A adapted to abut against the projection 12. The abutment surface 81A serves to restrict turning of the clutch plate 80, and so extends radially of the rotating shaft 11 of the clutch plate 80, that is, perpendicularly to a turning direction of the clutch plate 80 and obliquely intersects a straight line $\alpha$ connecting between the centers of rotation of the second gear 2 and the third gear 3.

Provided on the clutch plate 80 are a first elastic deformation portion 22 generating an elastic force to bias the abutment 81 of the clutch plate 80 in a direction toward the projection 12, and a second elastic deformation portion 23 generating an elastic force to bias the abutment 81 of the clutch plate 80 in a direction away from the projection 12.

Here, a winding stem 14 is provided to be able to advance or retreat from an interior of a timepiece 1 to cause elastic deformation of the first elastic deformation portion 22 in an advance position C to generate an elastic force and to return the first elastic deformation portion 22 in a retreat position D to an original state to lessen the elastic force.

In other words, when the winding stem 14 advances, an elastic force of the first elastic deformation portion 22 resists an elastic force of the second elastic deformation portion 23 to turn the clutch plate 80 to the first angular position A. In a state, in which the clutch plate 80 is positioned in the first angular position A, the third gear 3 makes the rotating shaft vertical as shown in FIG. 8 to have its pinion 3*b* meshing with the teeth 2*a* of the second gear 2.

Meanwhile, when the winding stem 14 retreats, an elastic force of the second elastic deformation portion 23 causes the clutch plate 80 to turn to the second angular position B. In a state, in which the clutch plate 80 is positioned in the second angular position B, the third gear 3 makes the rotating shaft oblique as shown by alternate long and two short dashes lines in FIG. 8 to release meshing of the pinion 3*b* and the teeth 2*a* of the second gear 2. However, meshing of the gear 3*a* and the pinion 4*b* of a fourth gear 4 is not released.

Since adoption of such clutch plate 80 causes elastic forces of the first elastic deformation portion 22 and the second elastic deformation portion 23 to move the clutch plate 80, the winding stem 14 can be operated with a small force and large forces are not applied on the winding stem 14 and the clutch plate 80, so that it is possible to set a diameter of the winding stem 14 and a thickness dimension of the clutch plate 80 to small values, which contributes to thinness and minimization of the timepiece 1.

Besides, no large force is necessary to operate the winding stem 14, so that the winding stem 14 can be smoothly operated to provide a comfortable feeling during operation.

However, a time correction mechanism adopting the clutch plate 80 involves the following problems.

That is, the projection 12 does not restrict displacement of the abutment 81 in a direction along the abutment surface 81A as shown in FIG. 9 and the straight line α connecting between centers of rotation of the second gear 2 and the third gear 3 obliquely intersects the abutment surface 81A, so that when the clutch plate 80 is deformed, the projection 12 and the abutment 81 allow displacement of the third gear 3 in a direction along an arrow β as shown in FIG. 9.

Therefore, there is caused a problem that when the clutch plate 80 is deformed upon a shock due to falling, or the like, a distance between centers of rotation of the second gear 2 and the third gear 3 is decreased making meshing of the pinion 3*b* of the third gear 3 and the teeth 2*a* of the second gear 2 deep, so that the rotating drive resistance of the second gear 2 and the third gear 3 becomes large, which increases in loss of mechanical energy and which negatively results in the timepiece being stopped.

Also, formed on the clutch plate 80 as shown in FIG. 10 is an engagement 84 being an engaging portion to engage with the winding stem 14. The engagement 84 is formed with an engaging surface 84A to engage with the winding stem 14. Since the engaging surface 84A is defined by a planar plane in contact with an outer peripheral surface of the columnar-shaped winding stem 14, there is also caused a problem that upon the rotating operation of the winding stem 14, the engagement 84 of the clutch plate 80 is moved in the rotating direction of the winding stem 14 and so an intended action cannot be carried out even when the winding stem 14 is operated.

OBJECTS OF THE INVENTION

A first object of the invention is to provide a timepiece, which eliminates undesirable meshing of gears even when a clutch plate is deformed.

Also, a second object of the invention is to provide a timepiece, in which time correction can be surely carried out when a winding stem is operated.

SUMMARY OF THE INVENTION

The invention provides a timepiece having indication members mounted on gears forming a gear train to indicate time, and a time correction mechanism operated by an external operating member to transmit an external operating force to an inside of the timepiece, comprising: at least two gears forming the gear train; the time correction mechanism comprising a clutch plate that engages a shaft of one of the two gears which mesh with each other; the time correction mechanism comprising a winding stem that turns the clutch plate between a first angular position, in which one of the two gears meshes with the other, and a second angular position, in which meshing of the two gears is released; the clutch plate comprising an abutment; a turning restricting portion comprising an abutted portion that abuts against the abutment of the clutch plate in order to position the clutch plate in the first angular position, and to restrict further turning of the clutch plate; and an abutment surface formed on at least one of the abutment of the clutch plate and the abutted portion of the turning restricting portion, and which bears on the other of the clutch plate and turning restricting portion, the abutment surface defining a surface substantially perpendicular to a straight line connecting between centers of rotation of the two gears.

In the invention, since the abutment surface formed on either of the abutment of the clutch plate and the abutted portion of the turning restricting portion defines a surface substantially perpendicular to a straight line connecting between centers of rotation of the two gears, even when the clutch plate is deformed, the abutment surface restricts displacement in a direction, in which a distance between centers of rotation of the two gears is decreased, to prevent deep meshing of these gears from becoming.

Therefore, even when the clutch plate is deformed, the rotating drive resistance of the two gears can be maintained small, thus preventing an increased loss of mechanical energy and an undesirable stoppage of the timepiece. Thereby, the first object of the invention can be attained.

In this regard, it is desired in the timepiece according to the invention that the surface substantially perpendicular to the straight line connecting between centers of rotation of the two gears be planar in a plane passing through a center of turning of the clutch plate.

Assuming that θ denotes an angle (see FIG. 6) formed between a straight line connecting between the center of turning of the clutch plate and a point of contact of the clutch plate in the first angular position and the turning restricting portion, and the perpendicular surface, dispersion of the first angular position of the clutch plate is $$\text{dispersion of the first angular position} = \text{dispersion of parts} \times (1+\sin\theta)$$

and so dispersion of the first angular position becomes minimum when $\theta=0$.

In view of this, since $\theta=0$ is materialized by making the perpendicular surface and a planar plane passing through the center of turning of the clutch plate in agreement with each other, dispersion of the first angular position of the clutch plate due to dispersion of parts or the like is decreased. Also, in order to surely position the clutch plate, it is desired that θ be at most 30°.

In the above timepiece, it is desired that the two gears be a second gear and a third gear, teeth of the second gear mesh with a pinion of the third gear, and the clutch plate engages with a shaft on a pinion of the third gear and is operatively turned to incline the third gear to separate the pinion of the third gear from the gear of the second gear.

With such configuration, the second gear, to which a minute hand is mounted, is cut off from a mechanism of speed regulation and a drive mechanism, so that a force of rotating operation applied on the winding stem for correction of time is not transmitted to the mechanism of speed regulation and the drive mechanism, which are provided on the third gear or a succeeding gear, and it is possible to freely make the time correction.

Also, in the above timepiece, it is preferable that the clutch plate be provided with a first elastic deformation portion generating an elastic force to bias the clutch plate in a direction toward the turning restricting portion, and a second elastic deformation portion generating an elastic force to bias the clutch plate in a direction away from the turning restricting portion, the external operating member comprising a winding stem, which is provided to advance and retreat from an interior of the timepiece, and which deforms the first elastic deformation portion upon advancement to generate an elastic force, and returns the first elastic deformation portion to an original state upon retreat to loosen the elastic force, and the first elastic deformation portion and the second elastic deformation portion are configured such that when the winding stem advances, the elastic force of the first elastic deformation portion resists the elastic force of the second elastic deformation portion to turn the clutch plate to the first angular position, and when the winding stem retreats, the elastic force of the second elastic deformation portion turns the clutch plate to the second angular position.

With such configuration, since elastic forces of the first elastic deformation portion and the second elastic deformation portion cause the clutch plate to be moved, the winding stem can be operated with a small force and large forces are not exerted on the winding stem and the clutch plate, so that it is possible to set a diameter of the winding stem and the thickness of the clutch plate to small values, which can contribute to the making of a thin and small timepiece.

Since no large force is necessary to operate the winding stem, it can be operated smoothly and comfortably.

Also, the invention provides a timepiece having indication members mounted on gears forming a gear train to indicate time, and a time correction mechanism operated by a winding stem to transmit an external operating force to an inside of the timepiece, comprising: at least two gears forming the gear train; the time correction mechanism comprising a clutch plate that engages a shaft of one of the two gears which mesh with each other; the clutch plate, responsive to the winding stem to turn between a first angular position, in which one of the two gears meshes with the other, and a second angular position, in which meshing of the two gears is released, and comprising an engaging surface formed on an engaging portion that engages with the winding stem, and the engaging surface being curved to follow an outer peripheral surface of the winding stem.

With such configuration, the engaging portion of the clutch plate is latched on the outer peripheral surface of the winding stem, so that even when the winding stem is operatively rotated, the engaging portion of the clutch plate is not moved in the direction of rotation and the winding stem is operated to surely carry out correction of time to enable attaining the second object of the invention. Accordingly, since the engaging portion of the clutch plate does not contact with the gear train bridge, deformation of the gear train bridge is prevented even without an increase in strength, so that it is possible to make the gear train bridge thin. Also, it is possible to arrange the gears above the clutch plate to make the timepiece thin and small in size.

Also, it is desired in the above timepiece that the clutch plate be formed from a sheet material, and the engaging surface be formed by bending a portion of the sheet metal substantially at a right angle, and cutting an end surface of the bent portion to follow a cross sectional shape of the winding stem.

With such configuration, the engaging surface curved to follow the outer peripheral surface of the winding stem is easily formed, so that production of the clutch plate is enhanced.

Further, it is desired in the timepiece according to the invention that the clutch plate be held by a spring member in a direction perpendicular to a turning surface of the clutch plate.

While the clutch plate is ordinarily held by a spring force, the spring force tends to maintain a position of the clutch plate in the case where a shock due to falling, or the like, is applied to the timepiece, but the clutch plate will turn in a range upon application of a shock or force exceeding the spring force, and meshing of the gears is released to cause shifting of positions indicated by the indication members. In contrast, with the timepiece according to the invention, the spring member presses the turning surface of the clutch plate against the main plate or the like, so that the clutch plate is surely held in the first angular position even when a shock due to falling, or the like occurs, and meshing of the gears is difficult to release, thus preventing shifting of positions indicated by the indication members.

It is also preferred that the spring member be conductive to conduct electricity to the clutch plate.

With such configuration, the clutch plate is made electrically conductive through the spring member, so that electrical switching can occur through use of movement of the clutch plate at the time of turning, whereby an indication of whether the gears are put in a meshing state or in a released state is easily detected. Also, with the spring member used to make the clutch plate electrically. conductive, there is no need to provide a separate member exclusively for conduction, which reduces the number of parts and associated cost.

Figure 1:
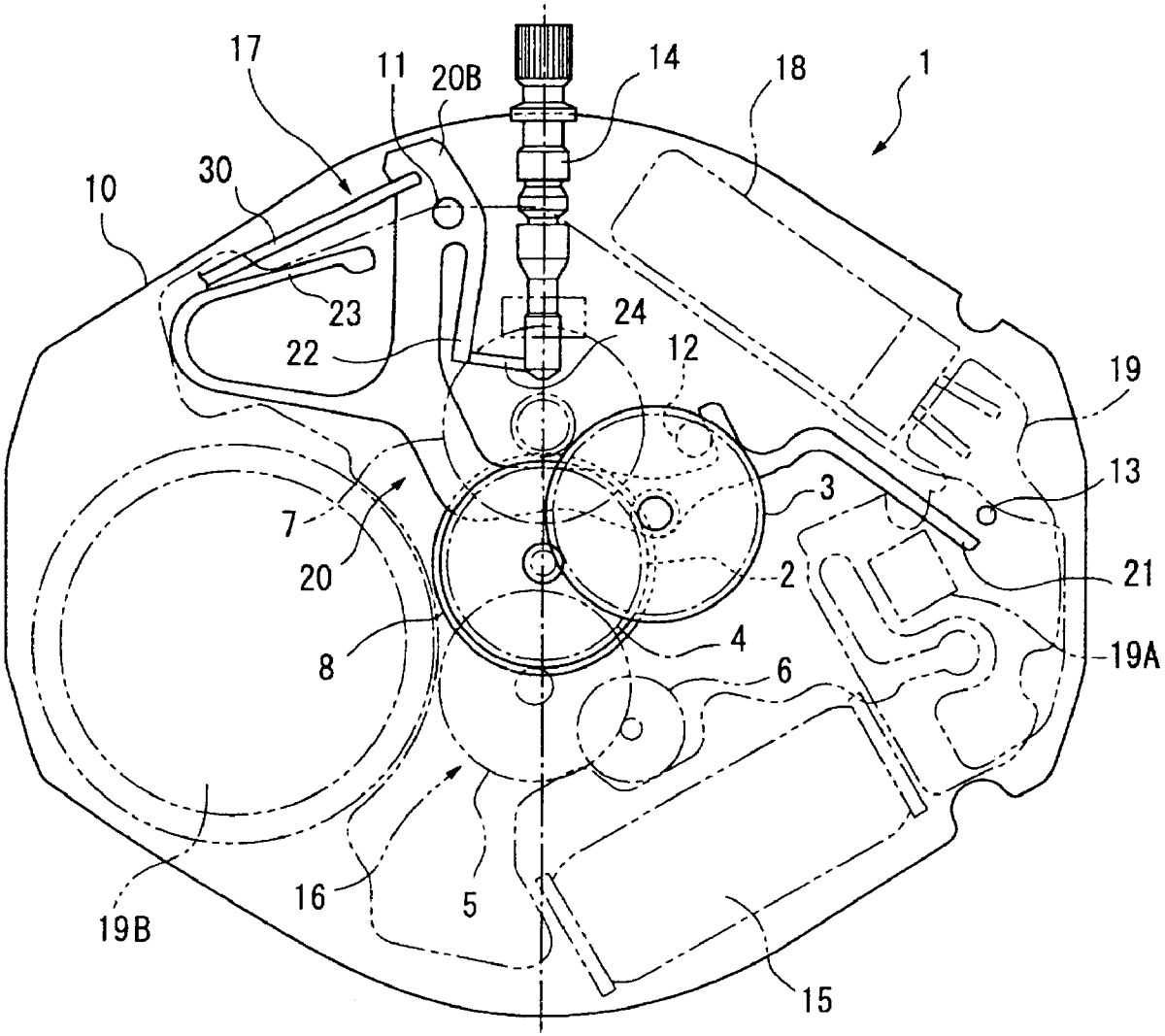
FIG. 1 is a plan view showing an embodiment of the invention as a whole.

The following is a brief explanation the numbers used in the drawings:

1: timepiece, 2 to 8: gears, 2: second gear, 2*a*: teeth of gear, 3: third gear, 3*b*: pinion of third gear, 3*c*: shaft, 12: projection as turning restricting portion, 12A: abutted portion, 14: winding stem as external operating member, 16: gear train, 17: time correction mechanism, 20: clutch plate, 20B: turning surface, 21: abutment, 21A: abutment surface, 22: first elastic deformation portion, 23: second elastic deformation portion, 24: engaging portion being an engaging portion adapted to engage with winding stem, 24A: engaging surface, 30: spring member, A: first angular position, B: second angular position, $\alpha$: straight line connecting between centers of rotation of two gears, $\delta$: straight line connecting between center of turning of clutch plate and point of contact of clutch plate in first angular position and turning restricting portion.

DESCRIPTION OF THE PREFERRED EMBODIMENTS

An explanation will be given below of an embodiment of the invention with reference to the drawings. In addition, the same parts as those described above are denoted by the same reference numerals, and an explanation therefor is omitted or simplified.

FIG. 1 shows a timepiece 1 according to the embodiment of the invention. Timepiece 1 may be a watch, wristwatch, clock, chronograph, stopwatch, etc. Within the timepiece 1, an stepping motor 15 rotatively drives a gear train 16, and indication members such as hands or the like, driven by gears 2 to 8 included in the gear train 16, indicate time. A time correction mechanism 17, operated by a winding stem 14 that is an external operation member, transmits an external operating force to the inside of the timepiece.

The timepiece 1 comprises an electronic circuit in addition to the stepping motor 15, the gear train 16, and the time correction mechanism 17. FIG. 1 shows an outline of a printed circuit board 19 on which an electronic circuit is formed. The electronic circuit includes an IC 19A that controls the rotating speed of the stepping motor 15, a quartz crystal that issues a signal of a normal frequency to the electronic circuit, a button battery 19B that supplies electric power to the stepping motor 15, the electronic circuit, etc.

Figure 8:
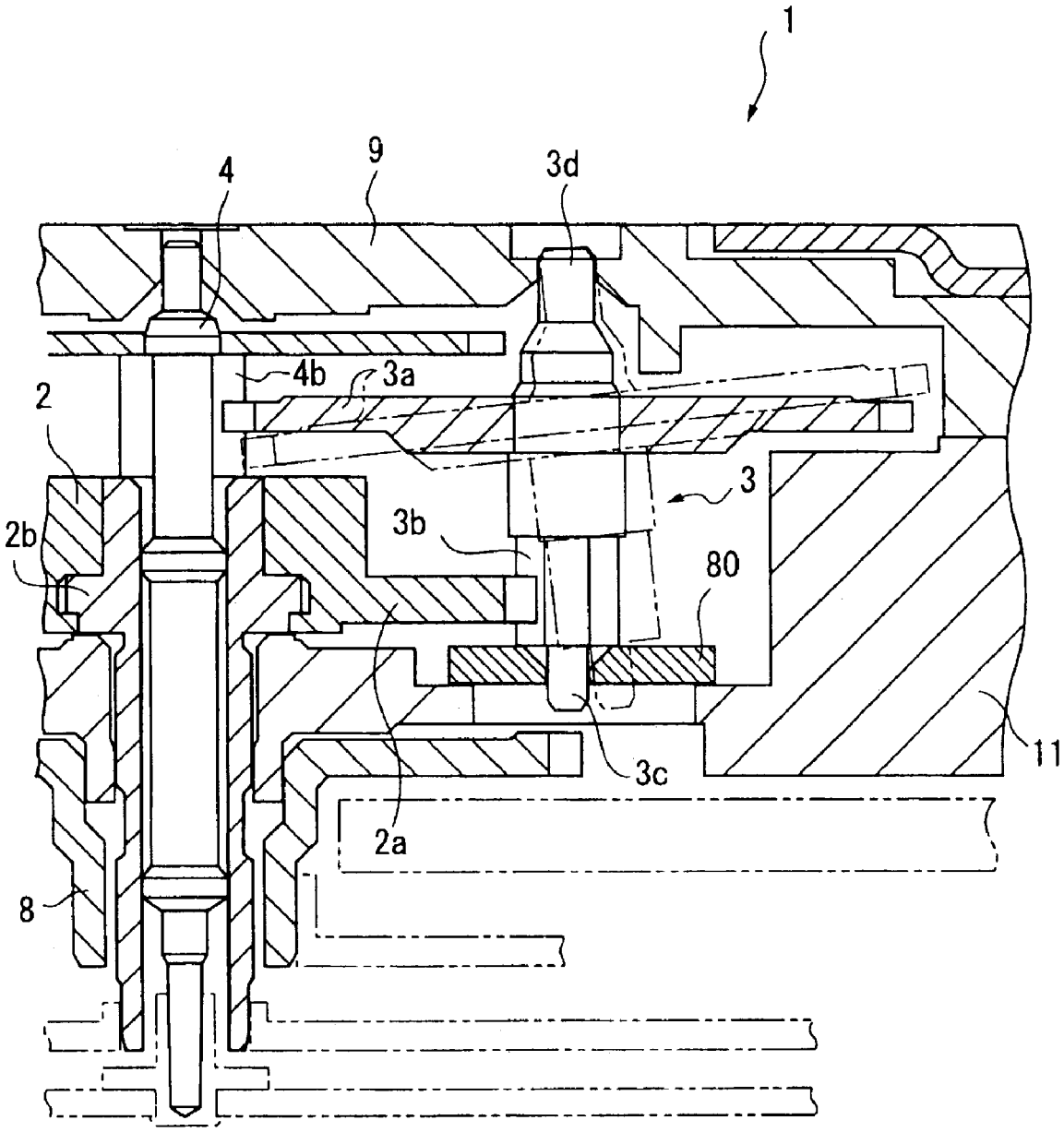
FIG. 8 is a cross sectional view illustrating an operation of the background art of the invention.
Figure 9:
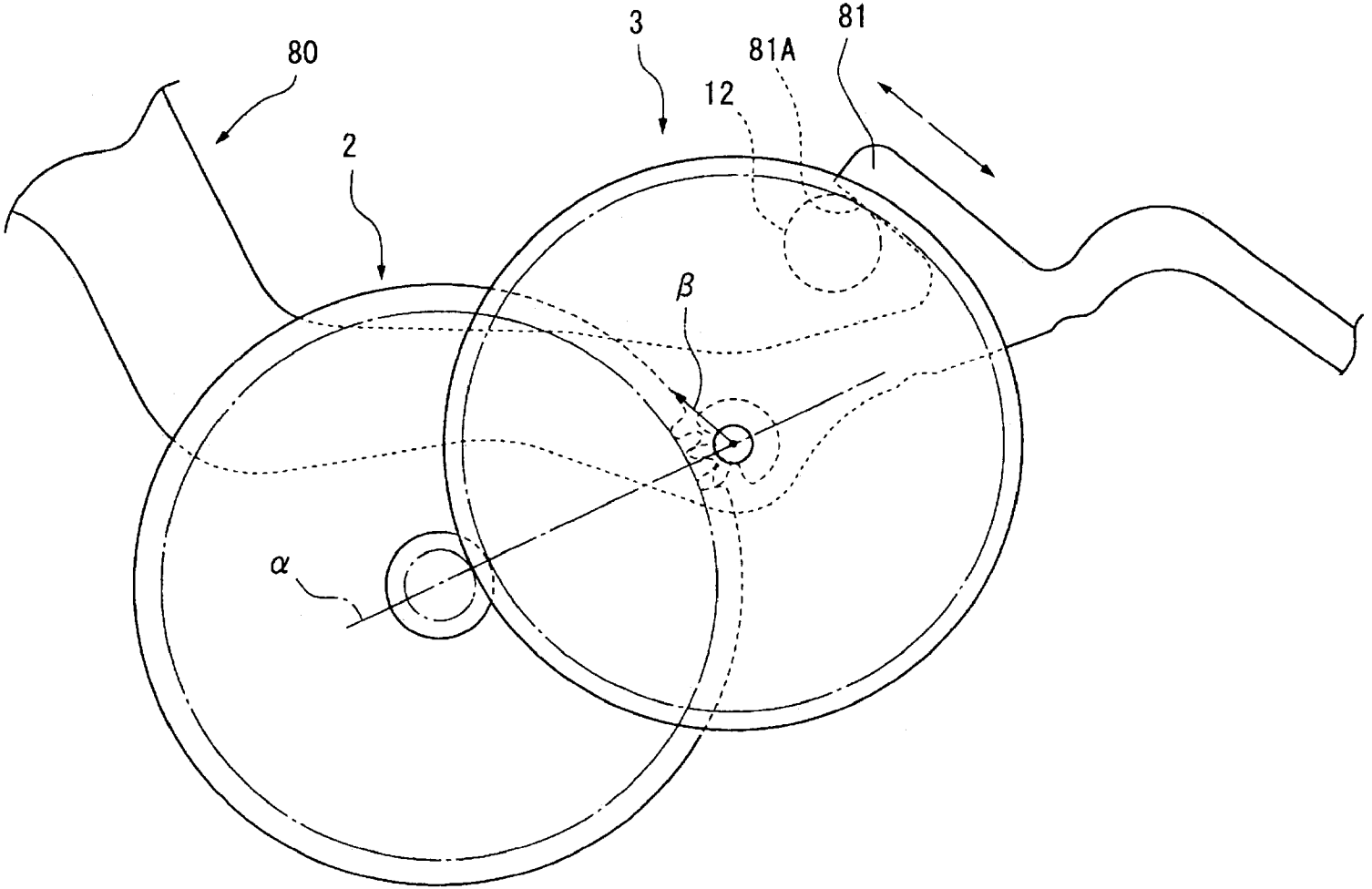
FIG. 9 is a view corresponding to FIG. 2 and showing an essential part of the example.
Figure 10:
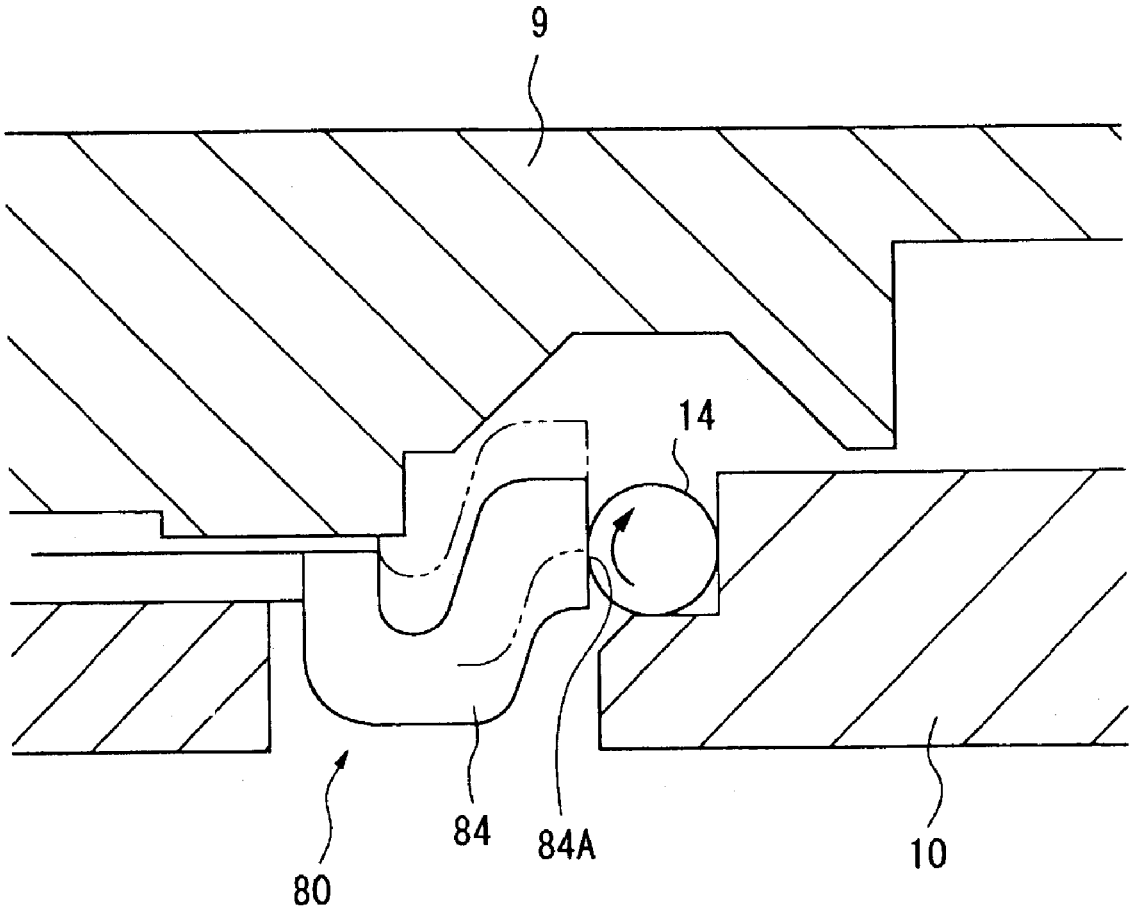
FIG. 10 is a view corresponding to FIG. 3 and showing a further essential part of the example.

The gear train 16 comprises, as gears, a rotor 6 of the stepping motor 15, a fifth gear 5, a fourth gear 4, a third gear 3, a second gear 2, a minute gear 7, and a hour gear 8. The third to fifth gears 3 to 5, the minute gear 7, and the hour gear 8 are formed from a synthetic resin. The second gear 2 is structured such that teeth 2*a* formed of a synthetic resin are integrally molded onto a metallic, cylindrical portion 2*b* as shown in FIG. 8. Here, an axis of rotation of the winding stem 14 and a center of rotation of the second gear 2 are arranged on the same straight line, as best seen in FIG. 1.

A clutch plate 20 formed by improving the above-described clutch plate 80 is provided on the time correction mechanism 17 in the embodiment of the present invention.

Figure 2:
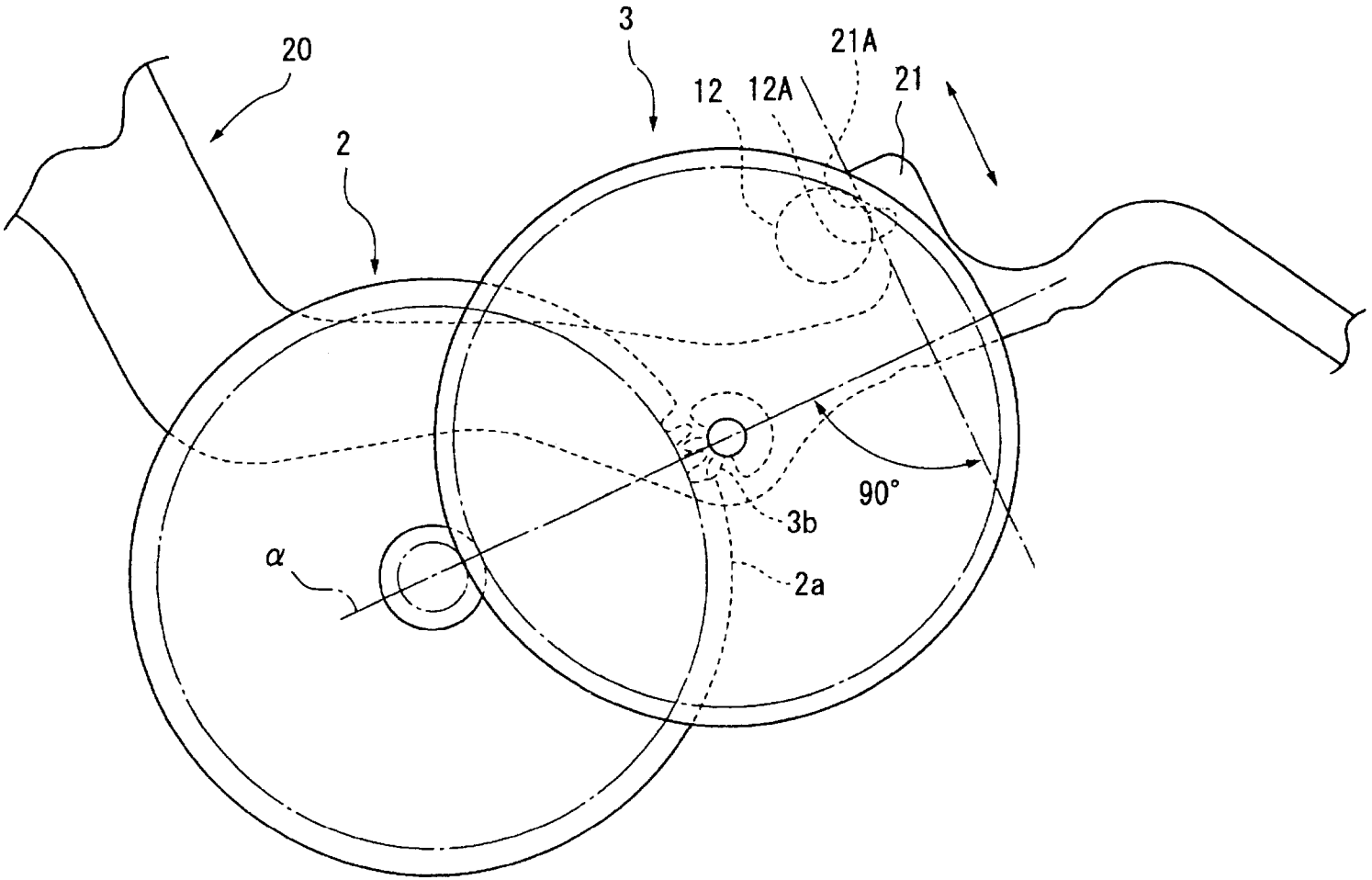
FIG. 2 is an enlarged plan view showing an essential part of the embodiment.
Figure 7:
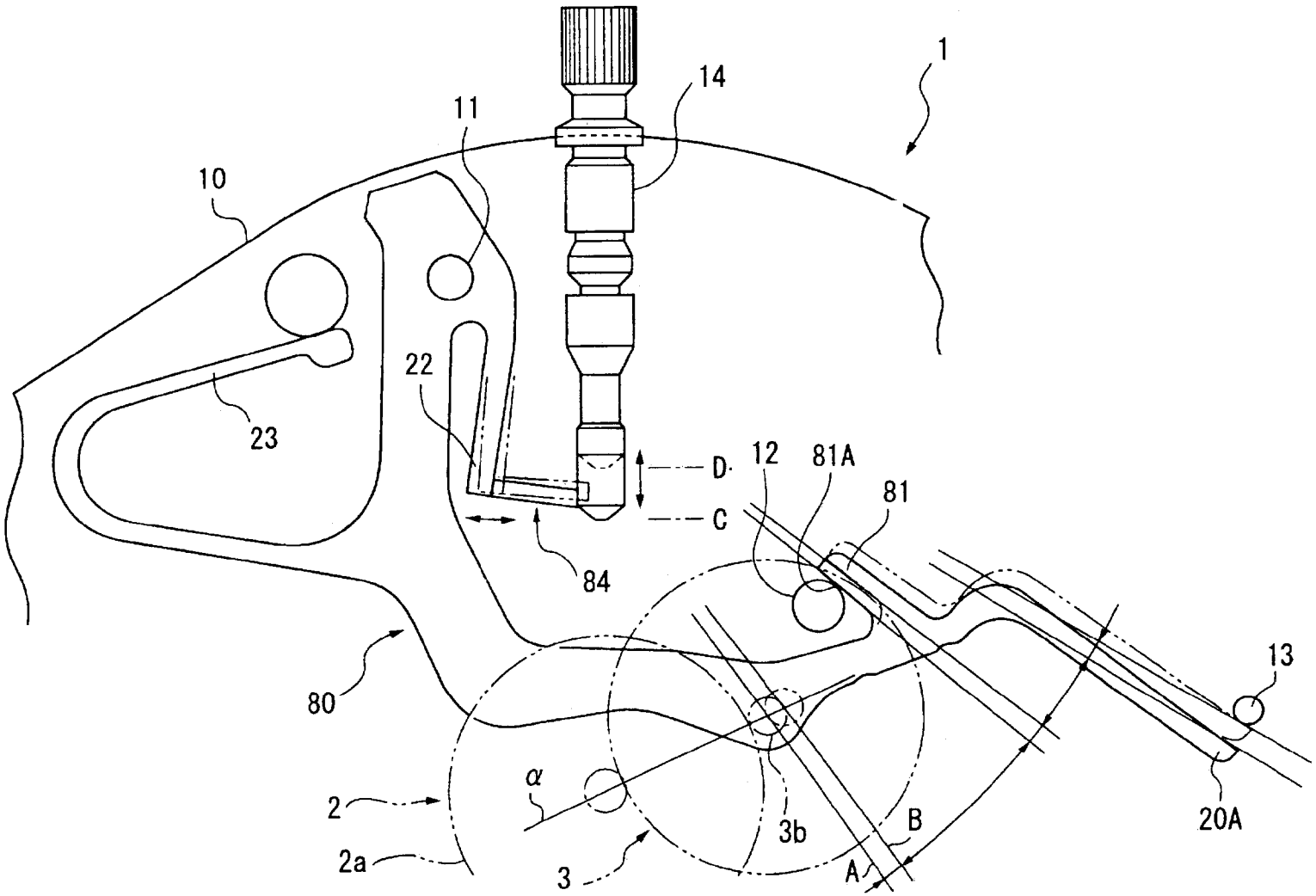
FIG. 7 is a plan view showing an example illustrating background art of the invention.

In the above-described clutch plate 80, the abutment surface 81A extending radially of the rotating shaft 11 of the clutch plate 80 obliquely intersects the straight line α connecting between centers of rotation of the second gear 2 and the third gear 3, as shown in FIG. 7. In the embodiment of the present invention, the abutment surface 81A is replaced by an abutment surface 21A substantially perpendicularly intersecting the straight line α connecting between centers of rotation of the second gear 2 and the third gear 3 as shown in FIG. 2. A material for the clutch plate is one of nickel silver, stainless steel, or the like because these materials have a desirable spring quality, corrosion resistance, and conductivity, have good workability and are cost effective.

Referring again to FIG. 1, a main plate 10 is provided with a projection 12, which serves as a turning restricting portion for restricting further turning of the clutch plate 20. The projection 12 may be formed integral with the main plate 10 or may be formed by a separate pin member, which is press fitted into the main plate 10.

Formed on the clutch plate 20 as shown in FIG. 2 is an abutment 21, which is provided in a position corresponding to the projection 12 and extends in a direction substantially perpendicular to the straight line α.

That portion of an outer peripheral surface of the projection 12, which faces the abutment 21, constitutes an abutted portion 12A, which abuts against the abutment 21 of the clutch plate 20.

The abutment 21 is formed with an abutment surface 21A. The abutment surface 21A is a surface substantially perpendicular to the straight line connecting between centers of rotation of the second gear 2 and the third gear 3.

Figure 3:
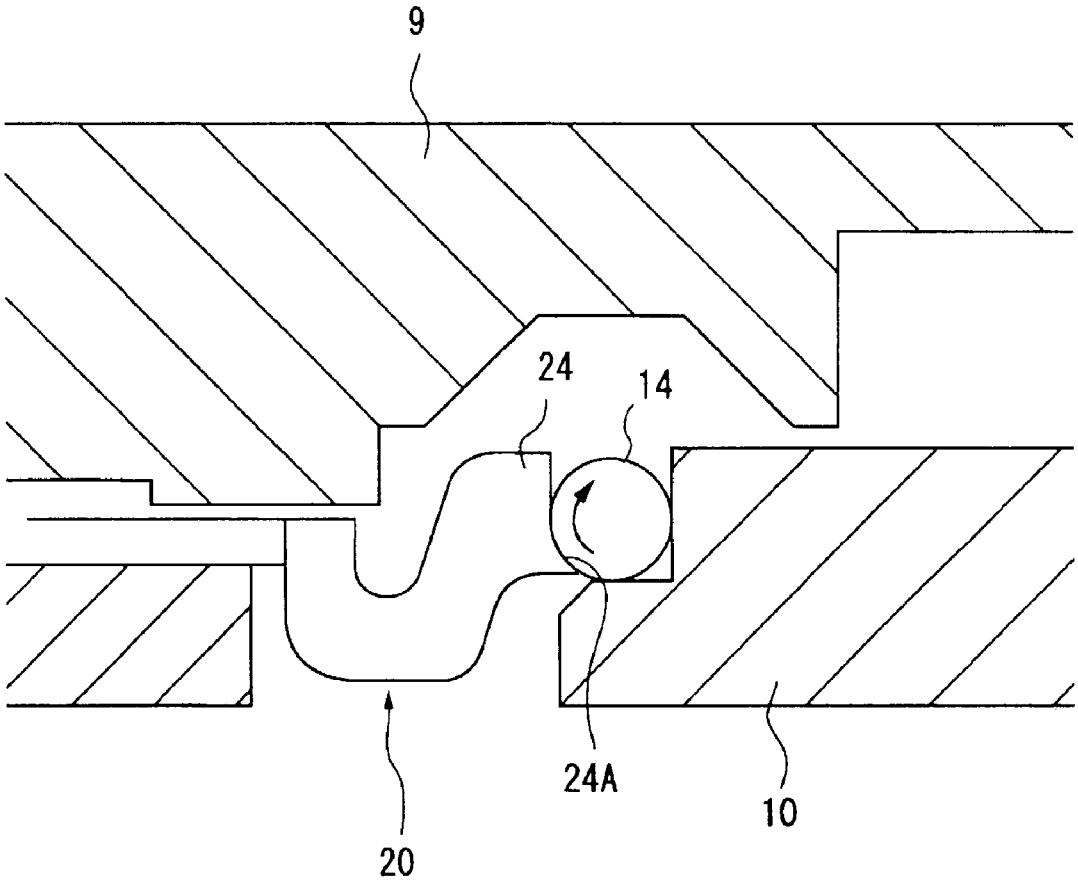
FIG. 3 is an enlarged plan view showing a further essential part of the embodiment.

Referring again to FIG. 1, the clutch plate 20 is formed with an engaging portion 24 for engagement with the winding stem 14. The engaging portion 24 is provided, as shown in FIG. 3, with an engaging surface 24A for engagement with the winding stem 14. The engaging surface 24A follows an outer peripheral surface of the winding stem 14, which is curved, and is shaped to fit between the winding stem 14 and the main plate 10.

The clutch plate 20 is formed, for example, by punching a sheet metal. The engaging surface 24A is formed, as shown in FIG. 4(A), by bending the engaging portion 24 substantially at right angle as shown in FIG. 4(B). The engaging surface 24A is cut following a cross sectional shape of the winding stem 14.

In addition, as shown in FIG. 4(C), the engaging surface 24A may be formed such that upper and lower portions thereof follow the cross sectional shape of the winding stem 14.

Figure 5:
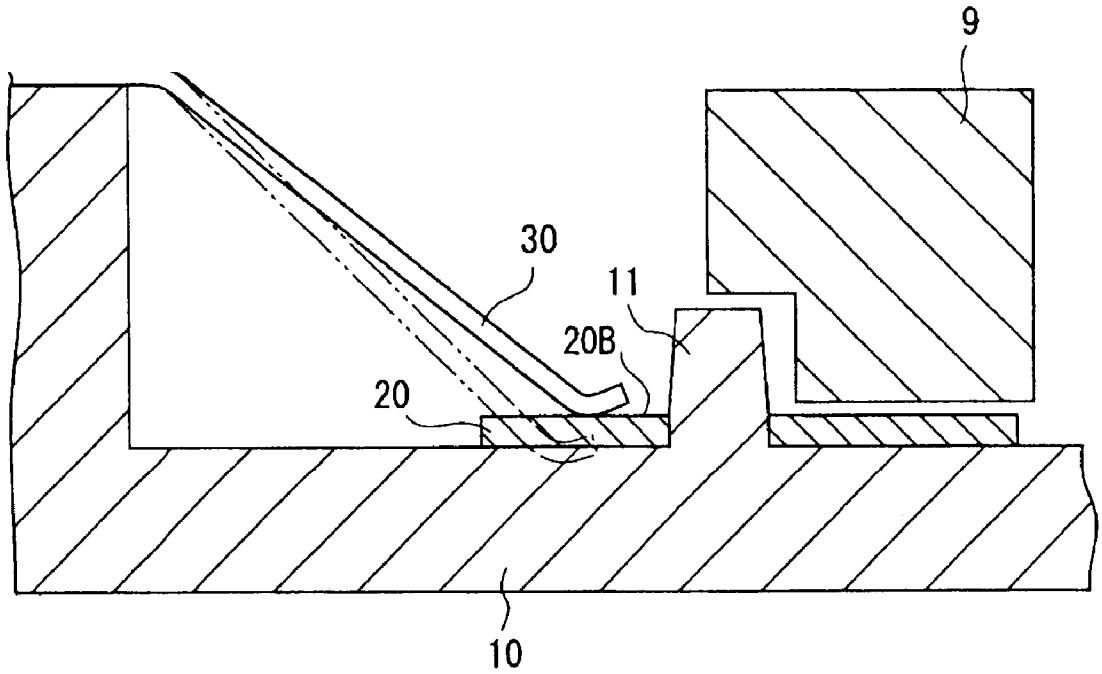
FIG. 5 is an enlarged plan view showing a still further essential part of the embodiment.

Also, referring to FIGS. 1 and 5, a flat turning surface 20B of the clutch plate 20 opposed to a gear train bridge 9 is pushed by a metallic spring member 30, having conductivity, toward the main plate 10. Thereby, a first elastic deformation portion 22 of the clutch plate 20 ordinarily holds the third gear 3 in a first angular position A (FIG. 7) and the spring member 30 favorably contributes to maintenance of the holding state so as to enhance the shock resisting property of the timepiece.

The spring member 30 is formed as a part of a circuit holder (not shown) for holding a printed circuit board. Here, the other part of the circuit holder is electrically conducted to a positive electrode (outer peripheral surface of the battery 19B) of the button battery 19B, and so the entire circuit holder functions as a positive terminal. Therefore, the clutch plate 20 in contact with the spring member 30 is also made conductive to be made positive in electric potential.

A tip end of the clutch plate 20 does not contact with the projection 13 when the second gear 2 and the third gear 3 mesh with each other, but contacts with the projection 13 when mutual meshing is released. The projection 13 is formed from a conductive metal for electrical connection with an electronic circuit on the printed circuit board 19. Therefore, the clutch plate 20 contacts the projection 13 to make an electrical switch according to a meshing state of the second gear 2 and the third gear 3. The IC 19A detects release of the third gear 3 from the second gear 2 on the basis of a reset signal produced by the switching. Based on the result of detection, driving of the stepping motor 15 is stopped, gear trains up to the fourth gear & pinion 4 are stopped, and movement of a fourth hand mounted on the second gear & pinion 4 is stopped at the time of correction of time.

The embodiment described above takes the following effects.

(1) In order to position the clutch plate 20 in the first angular position, in which the teeth 2*a* of the second gear 2 meshes with the pinion 3*b* of the third gear 3, the abutment 21 and the projection 12, respectively, are provided on the clutch plate 20 and the main plate 10. The abutment surface 21A provided on the abutment 21 is substantially perpendicular to the straight line α connecting between the centers of rotation of the second gear 2 and the third gear 3. So, even when the clutch plate 20 is deformed, the abutment surface 21A restricts displacement in a direction in which a distance between the centers of rotation of the second gear 2 and the third gear 3 is decreased. Thus, meshing of the second gear 2 and the third gear 3 is prevented from becoming too deep.

Therefore, even when the clutch plate 20 is deformed, the rotating drive resistance of the second gear 2 and the third gear 3 can be kept small, thus preventing an increase in loss of mechanical energy and the undesirable condition in which the timepiece is stopped.

(2) The clutch plate 20 turns to release meshing of the teeth 2*a* of the second gear 2 and the pinion 3*b* of the third gear 3. The second gear 2, to which a minute hand is mounted, is thus cut off from a mechanism of speed regulation and a drive mechanism. So, the force of rotating operation applied on the winding stem 14 for correction of time is not transmitted to the mechanism of speed regulation and the drive mechanism, which are provided on the third gear or a succeeding gear. The mechanism of speed regulation and the drive mechanism are therefore not adversely influenced even when the winding stem 14 is operatively rotated to freely make correction of time.

(3) The first elastic deformation portion 22 generating an elastic force to bias the clutch plate 20 in a direction toward the projection 12, and the second elastic deformation portion 23 generating an elastic force to bias the clutch plate 20 in a direction away from the projection 12 are provided on the clutch plate 20. When the winding 14 is advanced, an elastic force of the first elastic deformation portion 22 resists an elastic force of the second elastic deformation portion 23 to turn the clutch plate 20 to the first angular position A. When the winding stem 14 retreats, an elastic force of the second elastic deformation portion 23 causes the clutch plate to turn to the second angular position B. Thus, the winding stem 14 can be operated with a small force and large forces are not exerted on the winding stem 14 and the clutch plate 20. It is therefore possible to make the diameter of the winding stem 14 small also make the thickness of the clutch plate 20 to small, which contribute to a thin and miniaturized timepiece 1.

Since a large force is not required to operate the winding stem 14, the winding stem 14 can be operated smoothly and comfortably while correcting the time on the timepiece.

(4) The engaging portion 24 of the clutch plate 20, which engages with the winding stem 14, is provided with the engaging surface 24A that is curved following an outer peripheral surface of the winding stem 14. The engaging portion 24 of the clutch plate 20 is latched on the outer peripheral surface of the winding stem 14 at the time of the operation of time correction. Since, surface 24A is curved, the engaging portion 24 of the clutch plate 20 is not moved in the rotating direction even when the winding stem 14 is operatively rotated, and so it is possible to surely make correction of time with the operation of the winding stem 14. Accordingly, the gear train bridge 9 can be made thin. Also, the third gear 3 can be arranged above the clutch plate 20, thus contributing to the small size and thinness of the timepiece 1.

Since the engaging portion 24 of the clutch plate 20 is not moved in the direction of rotation of the winding stem 14 even when the winding stem 14 is operatively rotated, it is possible to prevent the engaging portion 24 from contacting and deforming the gear train bridge 9. Therefore, it is unnecessary to increase the strength of the gear train bridge 9 to inhibit deformation, and it is possible to make the gear train bridge 9 thin.

(5) The clutch plate 20 is formed by punching a sheet metal, the engaging portion 24 is formed by bending a portion substantially at right angle. The engaging surface 24A is cut following the cross sectional shape of the winding stem 14. With this process, it is possible to easily form an engaging surface 24A that is curved to follow the outer peripheral surface of the winding stem 14, and to simplify and speed-up production of the clutch plate 20.

(6) With the timepiece 1, since the spring member 30 biases the turning surface 20B of the clutch plate 20 against the main plate 10, the clutch plate 20 can be surely held in the first angular position A even upon application of a shock due to falling, or the like. Also, meshing of the second gear 2 and the third gear 3 is made difficult to release, thus preventing shifting of positions indicated by the indication members.

(7) The spring member 30 serves also as a member conducting electricity to the clutch plate 20 and electric conduction is established through the spring member 30. Therefore, movement of the clutch plate 20 at the time of turning effects electrical switching between the spring member and the projection 13 to readily indicate whether the second gear 2 and the third gear 3 are put in a meshing state or in a released state. Also, since the spring member 30 is used as a member for causing conduction of the clutch plate 20, there is no need of separately providing any exclusive member for conduction, which can facilitate reduction in the number of parts and in cost.

In addition, the invention is not limited to the above respective embodiments but covers improvements and modifications thereof within a scope, in which the object of the invention can be attained.

Figure 6:
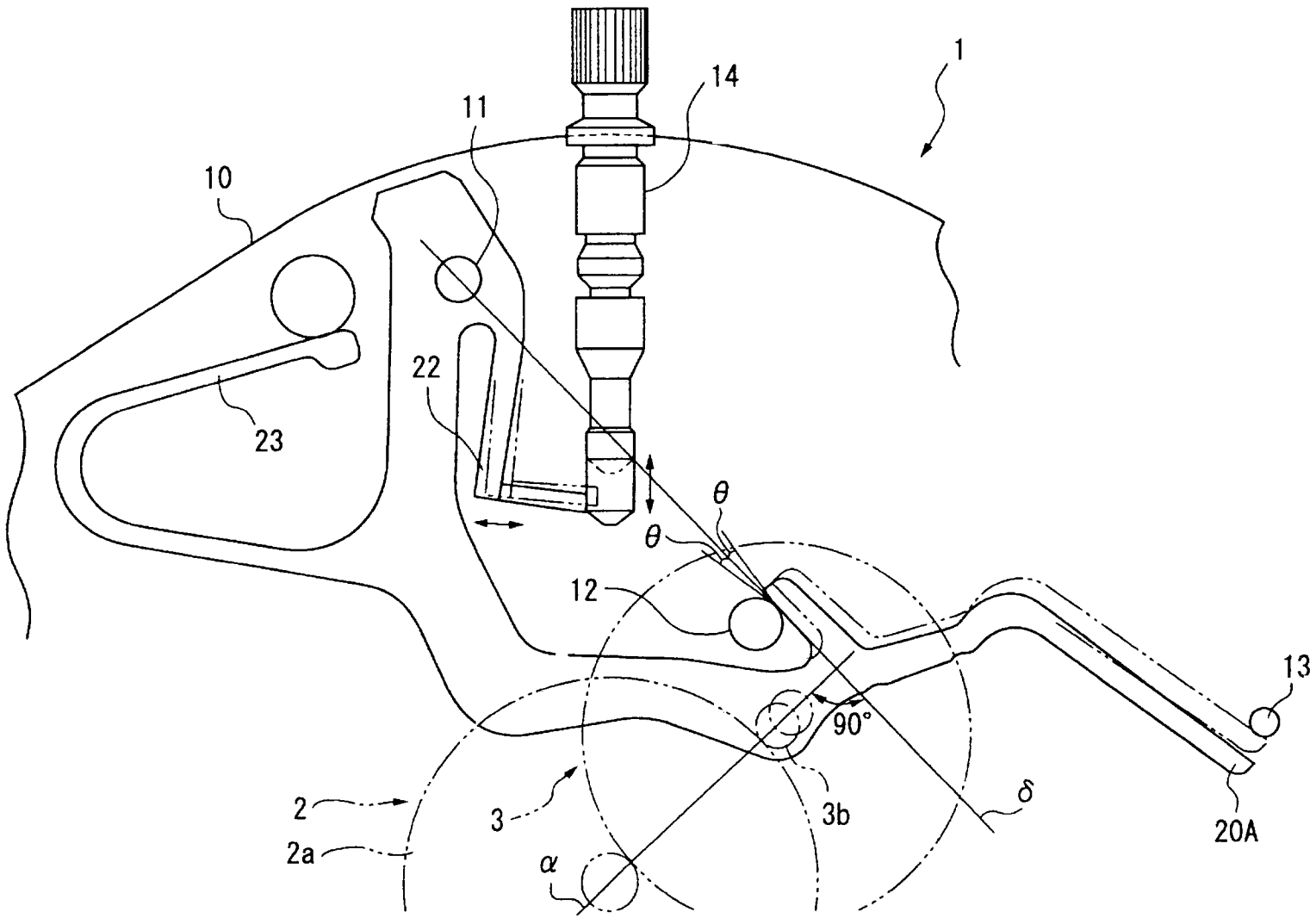
FIG. 6 is a plan view showing an example of a modification of the invention.

For example, with reference to FIGS. 2 and 6, the abutment surface 21A as a surface perpendicular to the straight line $\alpha$ connecting between the centers of rotation of the second gear 2 and the third gear 3 may be a planar plane including a straight line $\delta$ passing through the center of turning of the clutch plate 20. Assuming that $\theta$ denotes an angle formed between the straight line $\delta$ connecting between the center of turning of the clutch plate 20 and a point of contact of the clutch plate 20 in the first angular position A (FIG. 7) and the projection 12, and the abutment surface 21A, dispersion of the first angular position of the clutch plate 20 is $$\text{dispersion of the first angular position} = \text{dispersion of parts} \times (1+\sin\theta)$$

and so dispersion of the first angular position becomes minimum when $\theta=0$.

Accordingly, since $\theta=0$ is materialized by making the abutment surface 21A and a planar plane passing through the center of turning of the clutch plate 20 in agreement with each other, there is produced an effect that dispersion of the first angular position due to dispersion of parts or the like can be decreased.

Also, two gears included in the gear train and meshing with each other are not limited to the second gear and the third gear but may be the third gear and the fourth gear, and can be appropriately selected from gears included in the gear train provided that in short, when correction of time is to be made, meshing is released to enable avoiding transmission of a force of rotating operation applied on the winding stem to sides of the mechanism of speed regulation and the drive mechanism.

Also, the abutment surface being a surface substantially perpendicular to the straight line connecting between the centers of rotation of two gears is not limited to one provided on the abutment of the clutch plate but may be one provided on the abutted portion of the turning restricting portion.

In other words, a surface of the abutment 21 of the clutch plate 20 on a side of the projection 12 may be made a curved surface, a surface of the abutted portion 12A provided on the projection 12 on a side of the abutment 21 may be made a planar surface substantially perpendicular to the straight line $\alpha$ connecting between the centers of rotation of two gears, and the planar surface may serve as an abutment surface.

Further, while an abutment surface is provided only on the abutment of the clutch plate in the above embodiment, such abutment surface may be provided on the abutted portion of the turning restricting portion or on both the abutment of the clutch plate and the abutted portion of the turning restricting portion.

And, a shaft guide member adapted to engage with a shaft of the third gear may be provided separate from the clutch plate and the clutch plate may drive the shaft guide member to thereby release meshing of the second gear and the third gear.

Figure 4:
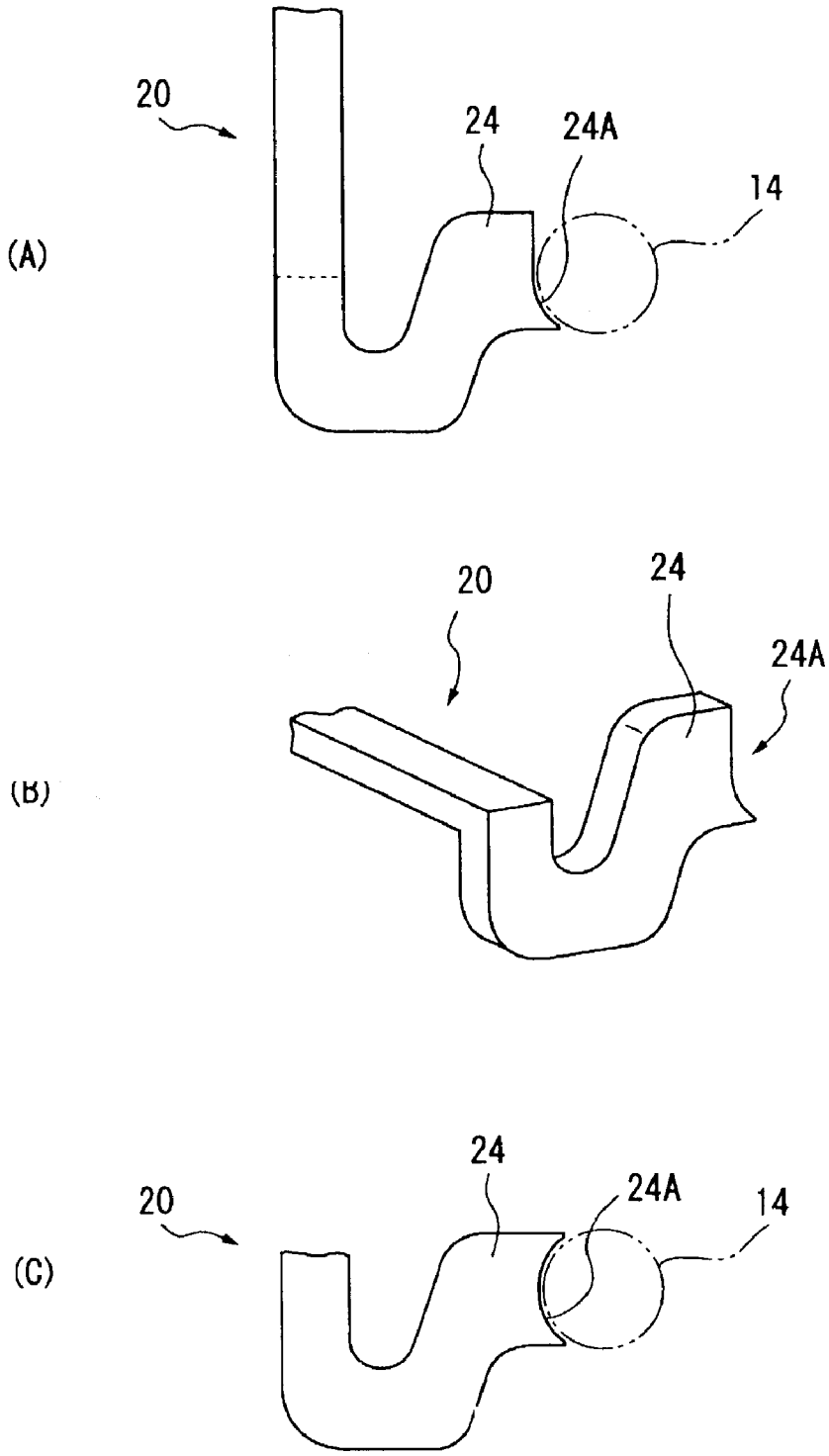
FIG. 4 is a view showing certain manufacturing steps of the embodiment.

Also, while the surface of the clutch plate adapted to engage with the winding stem is formed in the same manner as the engaging surface 24A shown in FIG. 4 to be curved following the cross sectional shape of the winding stem as viewed in side view, it may be formed from a plurality of continuous straight lines to approximate a shape of a curve in place of being formed to be curved.

As described above, according to the invention, even when the clutch plate is deformed, displacement is restricted in a direction in which a distance between the centers of rotation of the gears is decreased.

What is claimed is:

1. A timepiece having indication members mounted on gears forming a gear train to indicate time, and a time correction mechanism operated by an external operating member to transmit an external operating force to an inside of the timepiece, comprising:

at least two gears forming the gear train;

the time correction mechanism comprising a clutch plate that engages a shaft of one of the two gears which mesh with each other;

the time correction mechanism comprising a winding stem that turns the clutch plate between a first angular position, in which one of the two gears meshes with the other, and a second angular position, in which meshing of the two gears is released;

the clutch plate comprising an abutment;

a turning restricting portion comprising an abutted portion that abuts against the abutment of the clutch plate in order to position the clutch plate in the first angular position, and to restrict further turning of the clutch plate; and and an abutment surface formed on at least one of the abutment of the clutch plate and the abutted portion of the turning restricting portion, and which bears on the other of the clutch plate and turning restricting portion, the abutment surface defining a surface substantially perpendicular to a straight line connecting between centers of rotation of the two gears.

2. The timepiece according to claim 1, wherein the abutment surface substantially perpendicular to the straight line connecting between centers of rotation of the two gears is planar and lies in a plane passing through a center of turning of the clutch plate.

3. The timepiece according to claim 1, wherein the two gears are a second gear and a third gear in the gear train, wherein teeth of the second gear mesh with a pinion of the third gear, and wherein the clutch plate engages with a shaft on the pinion of the third gear and when operatively turned inclines the third gear to separate the pinion of the third gear from the teeth of the second gear.

4. The timepiece according to of claim 1, wherein the clutch plate comprises a first elastic deformation portion that generates an elastic force to bias the clutch plate in a direction toward the turning restricting portion, and a second elastic deformation portion that generates an elastic force to bias the clutch plate in a direction away from the turning restricting portion, the winding stem, responsive to the external operating force, to advance and retreat from an interior of the timepiece, deforming the first elastic deformation portion upon advancement to generate an elastic force, and returning the first elastic deformation portion to an original state upon retreat to lessen the elastic force, and the first elastic deformation portion and the second elastic deformation portion being configured such that when the winding stem advances, the elastic force of the first elastic deformation portion resists the elastic force of the second elastic deformation portion to turn the clutch plate to the first angular position, and when the winding stem retreats, the elastic force of the second elastic deformation portion turns the clutch plate to the second angular position.

5. The timepiece according to claim 1, further comprising a spring member that holds the clutch plate in a direction perpendicular to a turning surface of the clutch plate.

6. The timepiece according to claim 5, wherein the spring member is conductive to conduct electricity to the clutch plate.

7. A timepiece having indication members mounted on gears forming a gear train to indicate time, and a time correction mechanism operated by a winding stem to transmit an external operating force to an inside of the timepiece, comprising:

at least two gears forming the gear train;

the time correction mechanism comprising a clutch plate that engages a shaft of one of the two gears which mesh with each other;

the clutch plate, responsive to the winding stem to turn between a first angular position, in which one of the two gears meshes with the other, and a second angular position, in which meshing of the two gears is released, and comprising an engaging surface formed on an engaging portion that engages with the winding stem, and the engaging surface being curved to follow an outer peripheral surface of the winding stem;

wherein the clutch plate is formed from a sheet metal, and the engaging surface is formed by bending a portion of the sheet metal substantially at a right angle, and cutting an end surface of the bent portion to follow a cross sectional shape of the winding stem.

8. A timepiece having indication members mounted on gears forming a gear train to indicate time, and a time correction mechanism operated by a winding stem to transmit an external operating force to an inside of the timepiece, comprising:

at least two gears forming the gear train;

the time correction mechanism comprising a clutch plate that engages a shaft of one of the two gears which mesh with each other;

the clutch plate, responsive to the winding stem to turn between a first angular position, in which one of the two gears meshes with the other, and a second angular position, in which meshing of the two gears is released, and comprising an engaging surface formed on an engaging portion that engages with the winding stem, and the engaging surface being curved to follow an outer peripheral surface of the winding stem; and, a spring member that holds the clutch plate in a direction perpendicular to a turning surface of the clutch plate.

* * * * *